United States Patent [19]

Benzinger et al.

[11] Patent Number: 4,602,541

[45] Date of Patent: Jul. 29, 1986

[54] PUNCH PRESS WITH MEANS FOR ROTATING THE WORKPIECE AND METHOD OF USING SAME AND TOOLING THEREFOR

[75] Inventors: Martin Benzinger, Leinfelden-Echterdingen; Erich Brekle, Benningen, both of Fed. Rep. of Germany

[73] Assignee: Trumpf GmbH & Co., Ditzingen, Fed. Rep. of Germany

[21] Appl. No.: 678,709

[22] Filed: Dec. 6, 1984

[51] Int. Cl.[4] ..... B26F 1/02

[52] U.S. Cl. ..... 83/36; 83/137; 83/218; 83/251; 83/267; 83/277

[58] Field of Search ..... 83/36, 218, 251, 267, 83/277, 137, 390, 556, 559, 411 R

[56] References Cited

U.S. PATENT DOCUMENTS

| | | | |
|---|---|---|---|
| 3,877,332 | 4/1975 | Roch | 83/36 X |
| 4,144,783 | 3/1979 | Yamazaki | 83/219 X |
| 4,235,139 | 11/1980 | Haenni | 83/36 X |
| 4,391,123 | 7/1983 | Salvagnini | 83/36 X |

*Primary Examiner*—James M. Meister

[57] ABSTRACT

A punch press which has an X-Y guidance system for moving the workpiece relative to the workstation also includes means for rotating the workpiece on the worktable upon release of the workpiece from the X-Y guidance system. In this fashion, the workpiece may be rotated into a reoriented position and then reclamped in that position within the X-Y guidance system. This press includes a tool mounting means on the head of the press and means for effecting reciprocal motion of the tool mounting means along a vertical axis and rotation of the tool mounting means about that axis. Generally, the press will also include a die assembly in the base which includes at least a portion which is rotatable about the same vertical axis so that the workpiece when gripped therebetween may be freely rotated in a fixed clamped position to effect the desired reorientation. The tool mounting means may comprise the punch mounting mechanism, or the stripper mounting mechanism, and the entire lower portion of the ram assembly may be rotatable, or only the stripper assembly.

21 Claims, 23 Drawing Figures

P
14
16
10
24
220
222b 222c
222d
220
222b
222a 220
222b
10
16
222a
24

222b
10
222a
24
220

222b
10
222a
24

222b
24
220
10
222a 222b
24
220
10
222a
222a
222d

PUNCH PRESS WITH MEANS FOR ROTATING THE WORKPIECE AND METHOD OF USING SAME AND TOOLING THEREFOR

BACKGROUND OF THE INVENTION

As is well known, punch presses are highly useful for producing various types of cutouts in sheet-like workpieces of metal, plastic, composite materials and the like. In recent years, numerically controlled punch presses have enabled the production of relatively complex cutouts by repetitive punch strokes in nibbling operations, because movement of a workpiece clamping mechanism may be controlled by an X-Y coordinate guidance system.

Moreover, with the advent of large turret assemblies in turret-type punch presses and with the later advent of automatic tool changer type punch presses, a fairly large amount of tooling may be provided within the press so that the operative punch and die may be readily changed. Thus, even complex configurations have been made possible through the optimization of computer numerically controlled systems in presses providing a multiplicity of interchangeable tools.

In most punch presses employing workpiece clamping elements which are moved by an X-Y coordinate system, there is some limitation as to areas of the workpiece which can not be subjected to the punching operation. In some instances, this will be caused by that portion of the workpiece necessarily occupied by the clamping elements; in others, by the interference that would result from the movement of the clamping elements against other portions of the press; in still others involving large workpieces, by the limitation in the total amount of movement of the clamping elements along the X-Y axes.

Generally, most machines utilize a guidance mechanism disposed adjacent the center piston of a C-shaped frame. These machines have a throat determined by the length of the spring between the rearmost position of the guidance and clamping mechanism and the punch work position. This throat distance generally limits the dimension of the workpiece.

Thus, it is sometimes necessary to release the clamping elements and then manually to move the workpiece so that it can be clamped again in a new orientation. In some instances, the clamping elements will merely be released and moved along the X axis to grip the workpiece at a point spaced from the original gripping position. When the workpiece released from clamping action, there is a potential for minor movement due to vibrations of the machine itself or ambient vibrations, and thus can cause substantial difficulties in producing a final product to precision tolerances.

On occasion, this will entail rotation of the workpiece 90° or even 180°. Obviously, such manual activity interrupts the automatic operation of the press by the computer control, increases the time required and cost and provides the potential for misalignment.

Recently there have been introduced punch presses which permit variation in the nature of the cutouts produced by rotation of the tooling may be coupled with the indexing of the workpiece to spaced positions to produce cutouts with the tooling rotated relative to the X and Y axes of movement of the workpiece so that the cutouts are at different angular relationships. The availability of such rotary action for the punch press tooling provided by these two rotary action presses has thus increased the versatility of a single set of tooling.

It is an object of the present invention to provide a novel punching method which enables the workpieces to be moved by the guidance system, rotated to a new orientation on the punch press base, and again clamped in the guidance system.

It is also an object to provide such a method in which the movement and reorientation are effected with precision and automatically.

Another object is to provide a novel punch press assembly which utilizes tooling that can be moved to clamp the workpiece and then to rotate the workpiece into a new orientation for gripping by the guidance and moving system.

A further object is to provide novel tooling for clamping and rotating a workpiece on a punch press.

SUMMARY OF THE INVENTION

It has now been found that the foregoing and related objects may be readily attained in a method for punching cutouts in a sheet-like workpiece by providing a punch press having a frame with a base and a head spaced thereabove supporting a ram assembly. It also includes workpiece clamping and moving means for moving a workpiece between the base and head along X and Y axes, tool mounting means mounted on the head for movement along a vertical axis and rotatable about the axis, and a die assembly in the base in alignment with the ram assembly. In the tool mounting means is mounted workpiece gripping tooling adapted to engage a workpiece when brought into contact therewith, and a sheet-like workpiece is supported on the base between the die assembly and the head. The workpiece is initially gripped in the workpiece clamping and moving means, and the tool mounting means is moved along the vertical axis to bring the workpiece gripping tooling into contact with the workpiece and to clamp the workpiece between the gripping tooling and the base. At this time, the workpiece is released from the workpiece clamping and moving means, and the tool mounting means is rotated about the vertical axis which thereby rotates the workpiece on the base to effect reorientation thereof relative to the X and Y axes. Now, the workpiece is reengaged in its reoriented position in the workpiece clamping and moving means, and the tool mounting means is moved away from the workpiece to release it from the workpiece gripping tooling.

In the preferred embodiments, the workpiece gripping tooling frictionally engages the workpiece, and desirably the workpiece is clamped between the workpiece gripping tooling and the die assembly of which at least a portion rotates with the workpiece and the tool mounting means. Most usually, the method includes the step of mounting in the die assembly a second workpiece gripping tooling cooperating with that of the head to frictionally engage the workpiece therebetween. The die assembly may include a die holder rotatably supported in the base and which rotates with the workpiece upon rotation of the tool mounting means. This die holder may have a die-receiving recess therein and workpiece gripping means disposed thereabout to cooperate with the workpiece gripping tooling of the head to frictionally engage the workpiece therebetween.

In one embodiment, tool mounting means is on a portion of the ram assembly, and this portion of the ram assembly is rotated about the vertical axis. The tool mounting means may comprise punch mounting means on the rotatable portion of the ram assembly and the work gripping tooling is inserted into the punch mounting means; the ram assembly portion will be moved downwardly in a controlled manner to effect the clamping engagement. However, the tool mounting means may also comprise a stripper assembly vertically movable on the ram assembly independently of vertical movement of the ram portion, in which case the workpiece gripping tooling is inserted into the stripper assembly. Thus, the portion of the stripper assembly carrying the tooling is moved downwardly in a controlled manner to effect the clamping engagement.

In another embodiment, the tool mounting means comprises a stripper assembly vertically movable and rotatable on the ram assembly independently of movement of the ram portion, and the workpiece gripping tooling is inserted into the stripper assembly. Here the portion of the stripper assembly carrying the tooling is moved downwardly in a controlled manner to effect the clamping engagement is thereafter rotated.

A punch press embodying the invention includes a frame providing a base and a head spaced thereabove, tool mounting means mounted on the head for movement along a vertical axis towards and away from the base and for rotation about this axis, first drive means for rotating the tool mounting means, second drive means for effecting controlled reciprocal movement of the tool mounting means along the vertical axis. Workpiece clamping and moving means is provided for moving a workpiece between the base and the head along X and Y axes, workpiece gripping tooling is disposed in the tool mounting means and is adapted to engage a workpiece on the base when brought into contact therewith. the press also has control means for controlling the operation of the first and second drive means and the workpiece clamping and moving means. Control means is operable (i) to operate the second drive means to move the tool mounting means along the vertical axis a controlled distance to clamp the workpiece against the base, (ii) to release the workpiece from the workpiece clamping and moving means, (iii) to operate the first drive means and rotate the tool mounting means and thereby the workpiece a predetermined amount, (iv) to reengage the workpiece in the workpiece clamping and moving means, and (v) to operate the second drive means to move the tool mounting means away from the base and release the clamping force on the workpiece. As indicated above, the punch press may utilize a ram assembly in the head with a lower portion which is reciprocatable along the axis and rotatable about the axis. In this case tool mounting means is supported on the ram assembly lower portion and rotatable therewith, and the first drive means effects rotation of the ram assembly lower portion and thereby the tool mounting means.

The punch press may also include a stripper assembly on the head rotatable with the ram assembly lower portion and which itself has a portion movable along the vertical axis which includes the tool mounting means.

In another embodiment, the punch press has a stripper assembly on the head having a portion movable along the vertical axis. This portion includes the tool mounting means, and is rotatable about the vertical axis and is engaged with the first drive means to effect rotation thereby.

The preferred punch press includes a die assembly in the base with at least a portion being rotatable about the vertical axis. Second workpiece gripping tooling may be provided in the die assembly to cooperate with that of the head to engage the associated workpiece therebetween. The die assembly may have a die holder rotatably supported in the base which rotates with the associated workpiece, and it may have a die-receiving recess therein and workpiece gripping means disposed thereabout to cooperate with the gripping tooling of the head to frictionally engage the associated workpiece therebetween.

The tooling will include first tool means having a mounting portion adapted to be seated in the rotatable portion of the ram assembly and friction means on its end surface adapted to frictionally engage the surface of a workpiece, and second tool means having a mounting portion adapted to be mounted in a die assembly and friction means on its end surface adapted to engage the surface of a workpiece. The friction means will generally comprise elastomeric material seated in the tool means, and the tooling may include biasing means in recesses in the tool means and friction elements biased outwardly thereby.

DETAILED DESCRIPTION OF THE ILLUSTRATED EMBODIMENTS

Figure 1:
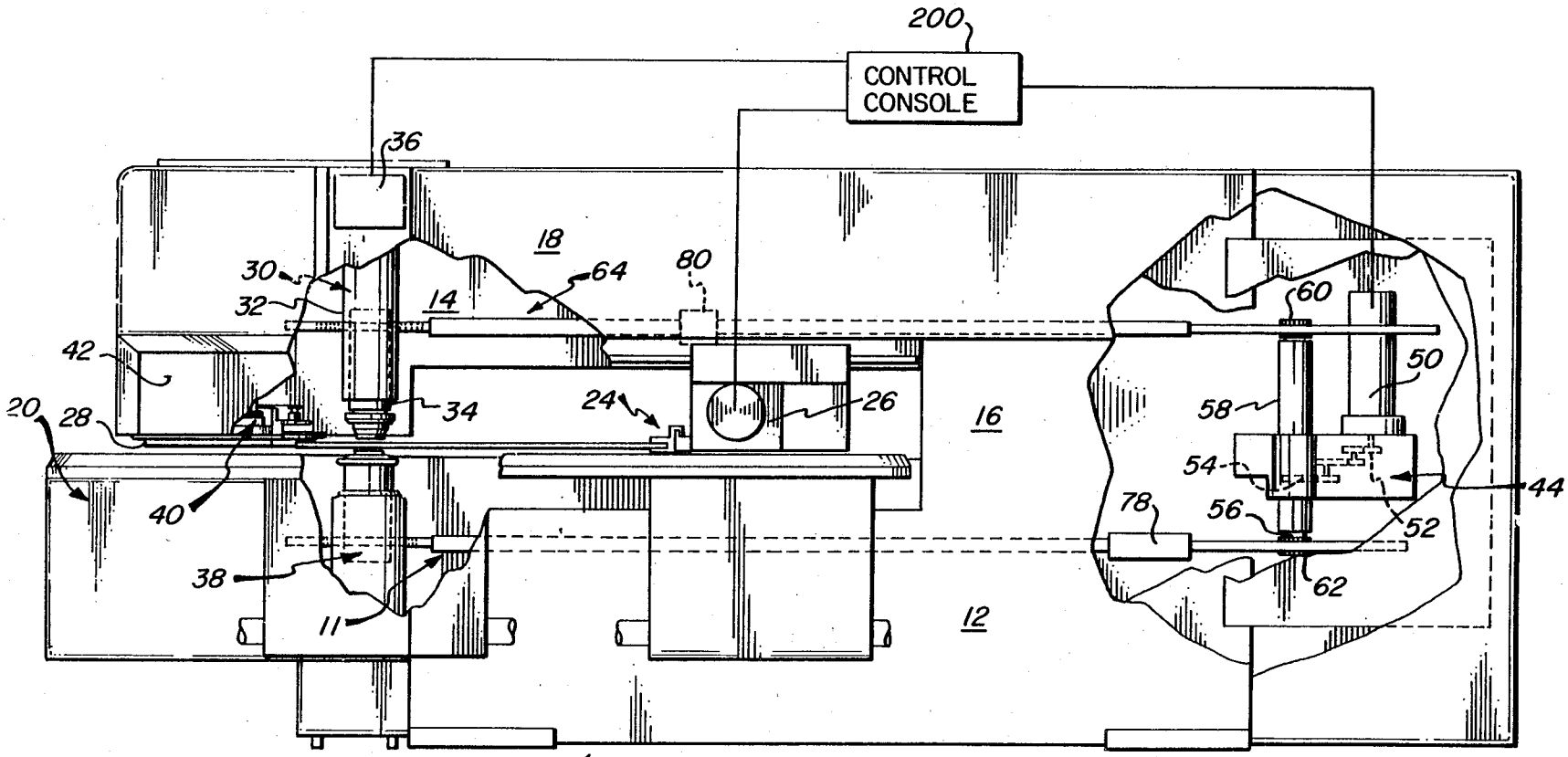
FIG. 1 is a partially diagrammatical side elevational view of an automatic tool changer type punch press embodying the present invention with portions broken away to reveal internal construction.

Turning in detail first to FIG. 1 of the attached drawings, therein illustrated is an automatic tool changer type punch press embodying the present invention which has a C-shaped frame generally designated by the numeral 10 providing a base 12, a head 14 extending in spaced relationship thereabove, and a vertically extending web or center section 16 at the rear thereof. Sheet metal covers 18 are mounted along the sides and front and rear thereof to enclose various elements of the structure and mechanical, electrical and hydraulic components for safety and aesthetic considerations.

A worktable generally designated by the numeral 20 is supported on the base 12. A workpiece clamping and indexing assembly generally designated by the numeral 24 is supported on the base 12 of the frame 10 adjacent the center section 16, and is movable along X and Y axes relative to the table 20 by drive mechanisms including that in the drive housing 26. In this fashion, the workpiece 28 may be moved in X and Y directions on the table 20 under the head 14.

Mounted on the forward end of the head 14 of the frame 10 is a ram assembly generally designated by the numeral 30 and including an upper portion 32 and a lower portion 34. The drive mechanism for reciprocating the lower portion 34 of the ram assembly 30 is located in the upper portion of the ram assembly 30 and is diagrammatically illustrated by the numeral 36. Mounted on the base 12 of the frame 10 is a die holder assembly generally designated by the numeral 38. An automatic tool changer mechanism generally designated by the numeral 40 is disposed within the tool changer housing 42 at the front of the press.

The distance between the rearward most position of the jaws of indexing assembly 24 and the tool position of the head defines the throat of the machine, and the length of a workpiece which can be operated upon.

In accordance with the present invention, the press includes a rotational assembly, generally designated by the numeral 44, for rotating the lower portion 34 of the ram assembly 30 and the die holder assembly 38. This includes a bi-directional motor 50 having a shaft on which is mounted the first of a series of gears in the gear train 52, which transmits the rotational output of the motor 50 to a pinion gear 54 mounted on the vertical shaft 56 intermediate its length. The shaft 56 is rotatably supported in the support member 58 and has pinion gears 60, 62 at its upper and lower ends.

Figure 2:
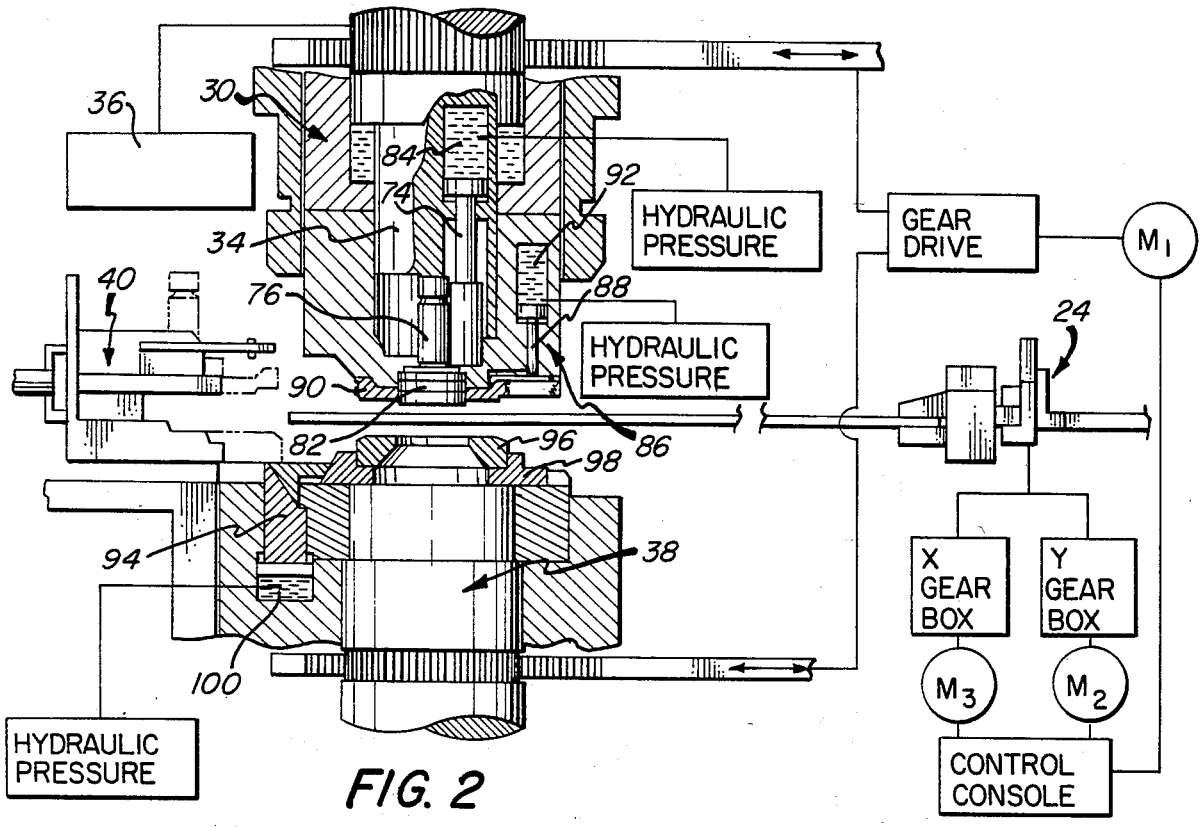
FIG. 2 is a partially diagrammatical, fragmentary side elevational view to an enlarged scale of the lower portion of ram assembly and upper portion of the die holder assembly with portions broken away to reveal internal construction, and also showing the automatic tool changer and workpiece clamping and guidance mechanisms and the gears for rotating the ram and die holder assemblies.

The pinion gears 60, 62 in turn mesh with rack gears 63 on the elongated horizontal members generally designated by the numerals 64, 66 which are slidably supported on guides 80 at spaced points along the length of the frame 10 for horizontal movement in either direction. The lower horizontal member 66 includes a threadably adjustable coupling 78 to permit adjustment of the overall length thereof. As best seen in FIG. 2, at their opposite ends the horizontal members 64, 66 have rack gears 63 which mesh with pinion gears 70, 72 on the periphery of the ram lower portion 34 and die holder assembly 38.

Turning now in detail to FIG. 2, the lower portion 34 of the ram assembly 30 has a hydraulic mechanism 74 which will clamp the stem 76 of the punch generally designated by the numeral 82 upon the introduction of pressurized hydraulic fluid to the chamber 84. The stripper holder assembly is generally designated by the numeral 86 and includes a hydraulic mechanism 88 for clamping the stripper tooling 90 upon introduction of pressurized hydraulic fluid to the chamber 92. The die holder assembly 38 also has a hydraulic clamping mechanism 94 for clamping the die 96 in the die holder block 98 upon introduction of pressurized hydraulic fluid into the chamber 100. Diagrammatically shown is the drive mechanism 34 for the ram assembly which may be a mechanical type using a crankshaft or eccentric to drive the ram assembly 30 and thereby to reciprocate the lower portion 34, or a hydraulic type in which the upper portion 32 is a cylinder in which reciprocates the upper end of the lower portion 34.

Figure 3:
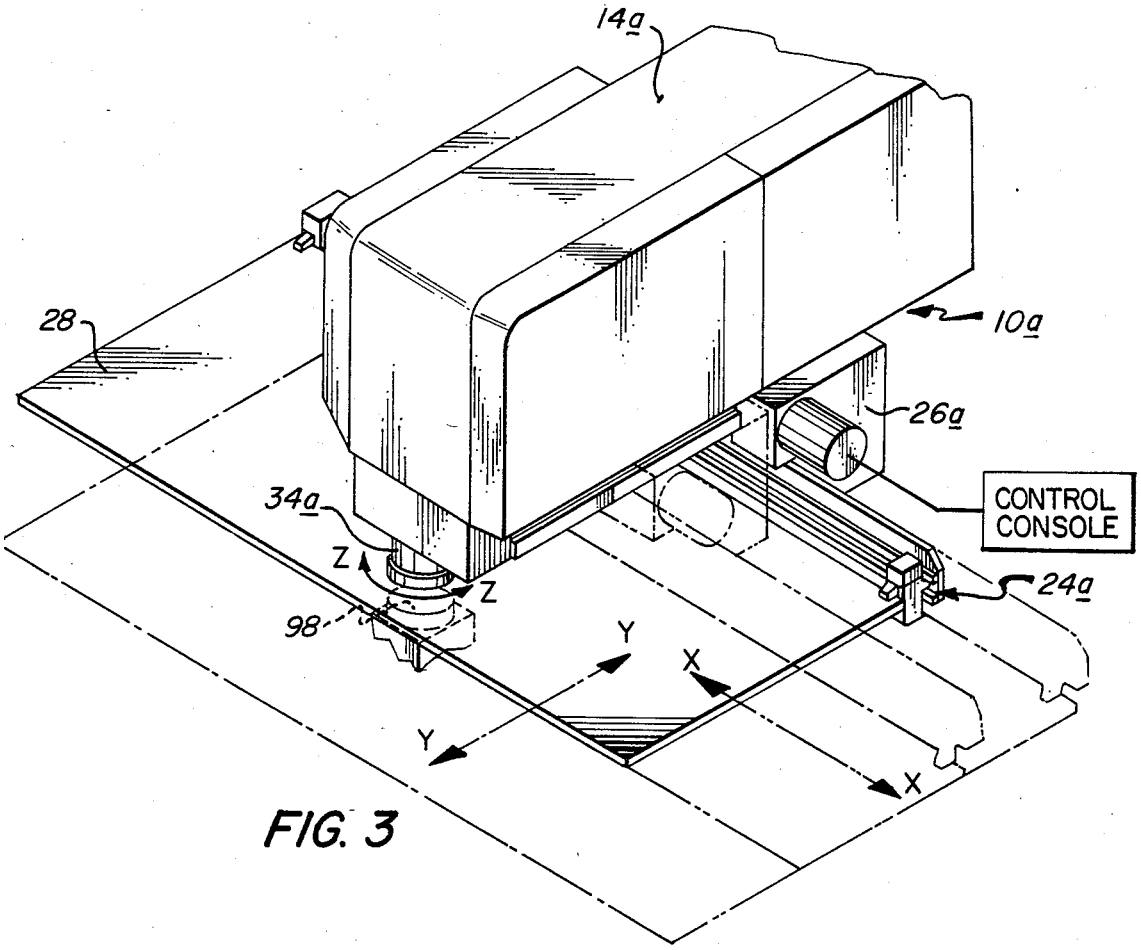
FIG. 3 is a partially diagrammatic and fragmentary perspective view of a manual tool changer type punch press with a workpiece on the worktable showing movement of the workpiece along X and Y axes by the workpiece clamping and guidance system.

In FIG. 3, there is fragmentarily illustrated a semi-automatic tool changer type punch press showing the head 14*a* of the frame 10*a* and the workpiece clamping mechanism 24*a* and one of its drive housings 26*a*. Between the lower portion 34*a* of the ram assembly and the die holder block 98 of the die holder assembly, is disposed a sheet-like workpiece 28 shown in phantom and solid line in several indexed positions resulting from movement of the clamping mechanism 24*a* into several indexed positions thereof also shown in phantom line and in solid line. The bi-directional rotation of the lower portion 34*a* of the ram assembly is indicated by the bi-directional arrow 2. In this type of press, the tooling is quickly changed in the ram assembly and in the die holder by manually operable tool cartridges.

Figure 4:
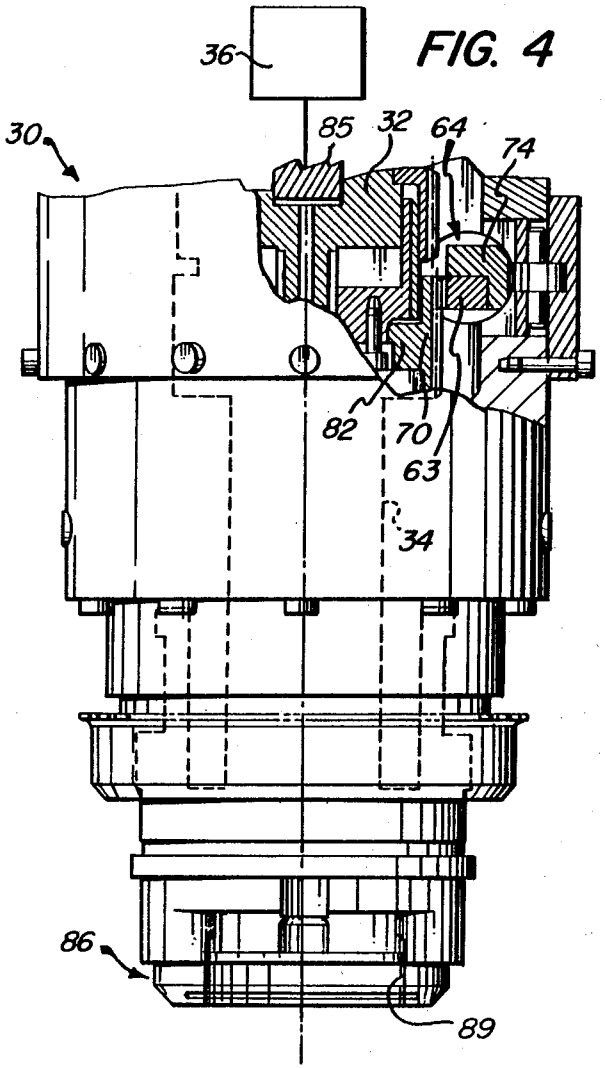
FIG. 4 is a fragmentary front elevational view to an enlarged scale of the lower portion of a ram assembly with portions broken away to reveal internal construction.

Turning now to FIG. 4, the intermeshing of the rack gear 63 with the pinion gear 70 on the ram assembly 30 may be seen in detail. The rack gear 63 is secured to the underside of the inverted L-shaped bar section 74 and has its teeth interengaged with the teeth of the pinion gear 70, which is in the form of a collar 82 supported on the upper end of the lower portion 34 of the ram assembly 30. In this view, the ram assembly is shown in a work engaging position, i.e., a lowered position of the lower portion 34. Because the lower portion 34 is rotatable about the upper portion 32, longitudinal movement of the rack gear 63 rotates the pinion gear 70 and thereby the lower portion 34. Depending upon the direction of longitudinal movement of the horizontal member 64, the lower ram portion 34 will be rotated clockwise or counterclockwise.

In this view can be seen the plunger 85 on the crankshaft extending into a recess in the upper end of the upper portion 32 because the illustrated embodiment utilizes a crankshaft or eccentric drive mechanism as the drive mechanism 36. The downstroke of the plunger 85 has caused the upper portion 32, and thereby the lower portion 34, to move downwardly in the housing of the ram assembly 30.

Also seen in this Figure is the stripper holder assembly generally designated by the numeral 86 which has a relatively wide recess 89 at its lower end in the front portion of its periphery for introduction of the punch and stripper tooling (not shown).

Figure 5:
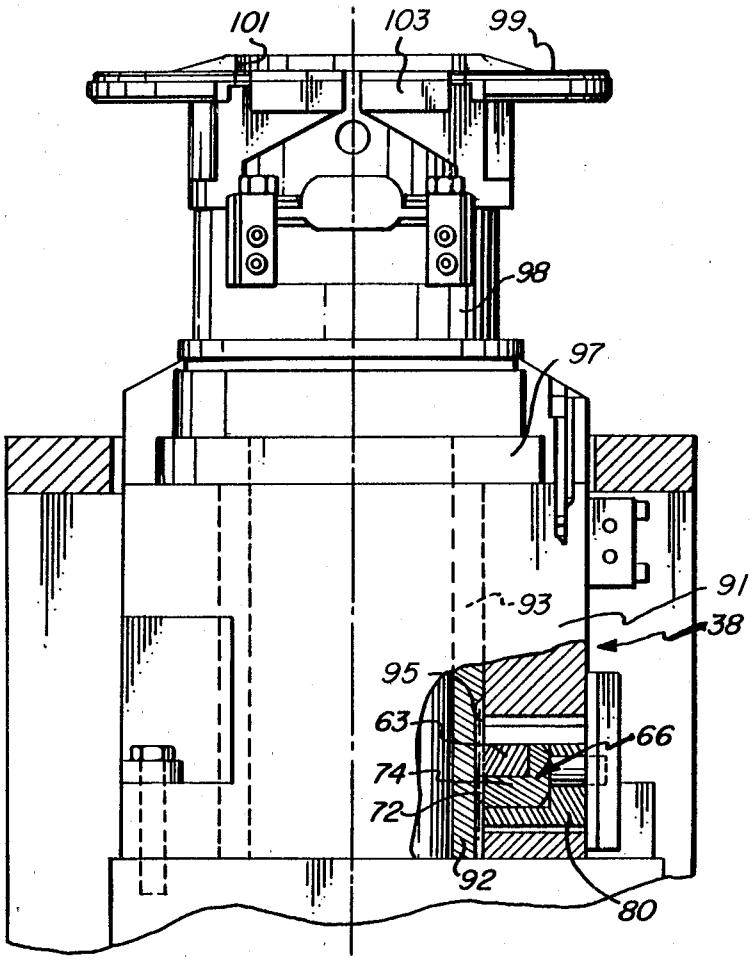
FIG. 5 is a fragmentary front elevational view to an enlarged scale of a die assembly console with portions broken away to reveal internal construction.

Turning now to FIG. 5, the die holder assembly 38 includes a support 91 and a generally tubular sleeve 92 with a collar 97 seated on the support 90. Adjacent its lower end, the periphery of the sleeve 93 is provided with axially extending gear teeth 95 and this member provides the pinion gear 72. The rack gear 63 is secured to the bar section 74 of the longitudinal member 66 and meshes with the teeth 95. It is slidable on the guide 80, and its longitudinal movement effects rotation of the die holder assembly 38. The die holder block 98 has a collar 99 extending about its upper periphery and a relatively large aperture 101 in its front portion to permit insertion of the die. The hydraulically actuated cam elements 103 will clamp the die 96 when it is inserted into the block 98. Since the block 98 is clamped to the sleeve 93, it will rotate therewith.

Figure 6:
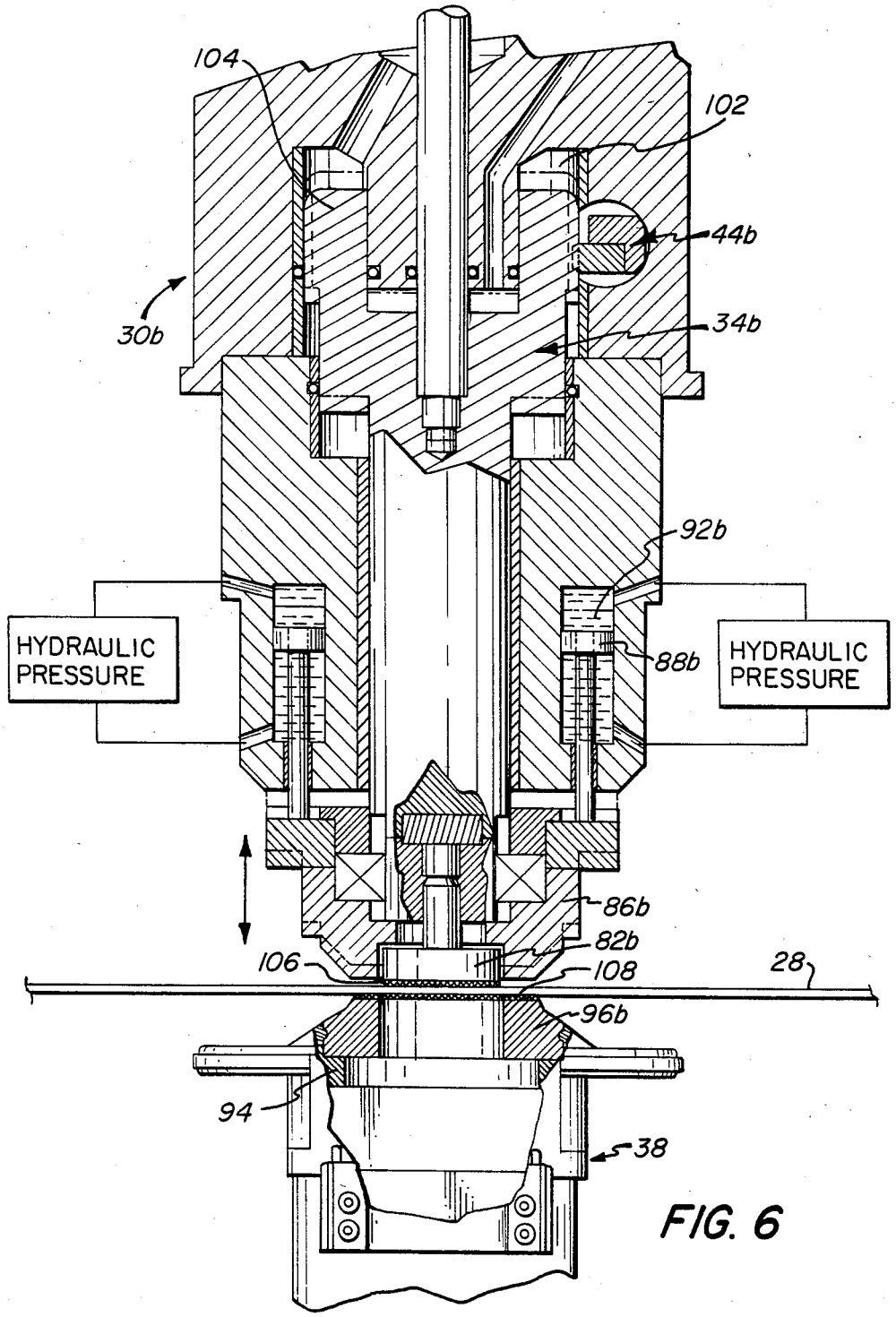
FIG. 6 is a fragmentary sectional and partially diagrammatic view of a hydraulically driven ram assembly and cooperating die assembly embodying the present invention with the punch and die tooling being utilized to grip the workpiece therebetween.

FIG. 6 illustrates a punch press ram assembly **30*b* which is hydraulically operated by pressurized hydraulic fluid introduced into the chamber 102 to reciprocate the ram lower portion 34*b* by fluid pressure acting on the upper and lower surfaces of the piston collar portion 104. The ram assembly 30*b* has a stripper assembly 86*b* at its lower end which is reciprocatable along a vertical axis by hydraulic fluid from the supply (diagrammatically illustrated) to the chamber 92*b* on either side of the piston 88*b***.

In this embodiment the punch **82*b* is provided on its lower surface with a layer 106 of resiliently deformable material for frictional engagement with the workpiece 28. Similarly, the die 96*b* is provided on its upper surface with a layer 108 of resiliently deformable material. By controlled introduction of the hydraulic fluid to the upper portion of the chamber 102, the lower portion 34*b* of the ram assembly 30*b* may be moved downwardly a controlled amount to cause the punch 82*b* to press the workpiece 28 firmly against the die 96*b* with the layers 106,108 of deformable material compressing and providing firm frictional engagement of the opposed surfaces of the workpiece 28. Accordingly, upon rotation of the lower portion 34*b* of the ram assembly 30*b* and the die holder assembly 38 by the rotational assembly 44*b*, the workpiece 28 is rotated upon the table 20** (not shown).

Figure 7:
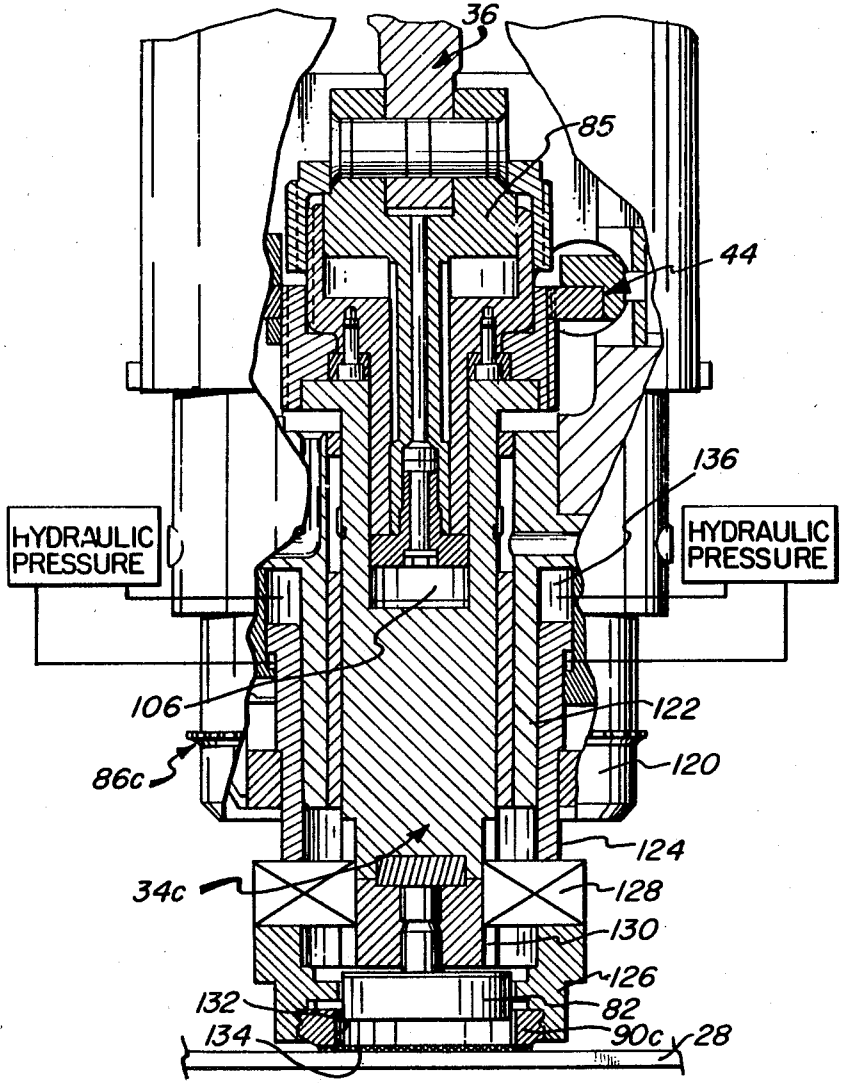
FIG. 7 is a fragmentary sectional and partially diagrammatic view of a mechanically driven ram assembly embodying the present invention with a hydraulically reciprocatable stripper assembly being used to grip the workpiece.

Turning now to FIG. 7, the ram assembly illustrated therein utilizes a mechanical ram actuation mechanism generally designated by the numeral 36 to reciprocate the lower portion **34*c*. The plunger 85 of the upper portion of the ram assembly sets on a volume of hydraulic fluid in a chamber 106 which provides a force limiting cushion in the transfer of the force of downward motion of the plunger 85 to the lower portion 34*c*. The rotational assembly 44 effects rotation of the ram lower portion 34*c*** as previously described with respect to prior figures.

Carried on the outer surface of the lower portion **34*c* is the stripper assembly 86*c* including the generally cylindrical housing 120, the generally cylindrical inner member 122, and the reciprocating element 124. The stripper holder 126 is carried by the lower end of the reciprocatable element 124 which is slidable in the chamber 136 formed between the inner member 122 and housing 120. The element 124 has inwardly extending projections 128 which slide in the axially extending guideways 130 of the ram assembly lower portion 34*c*. Secured in the stripper holder 126 is the stripper tooling 90*c* which has a central passage 132 for the punch 82 to pass therethrough. On its lower surface, the stripper tooling 90*c* has a layer 134 of resiliently deformable material to engage frictionally the upper surface of the workpiece 28 when the stripper element 124 is moved downwardly by hydraulic fluid admitted to the upper portion of the chamber 136**.

Figure 8:
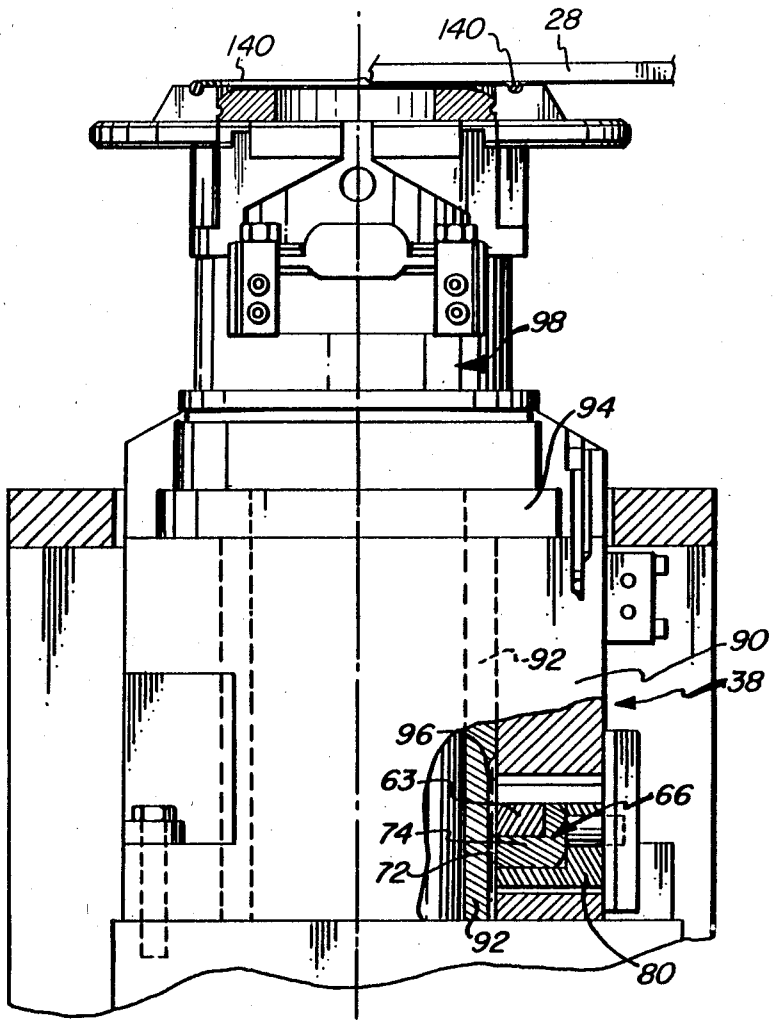
FIG. 8 is a fragmentary sectional view of the die assembly used with the ram assembly of FIG. 7 with the die holder used to grip the workpiece.

The die assembly illustrated in FIG. 8 is essentially similar to that in FIG. 5 and will not be described in detail. In this embodiment, the die holder block 98 has a ring 140 of resiliently compressible material seated in a recess in its upper surface and projecting above the surrounding surface thereof. When the workpiece 28 is pressed downwardly, the material of the ring 140 is compressed to firmly grip the lower surface thereof.

Figure 9:
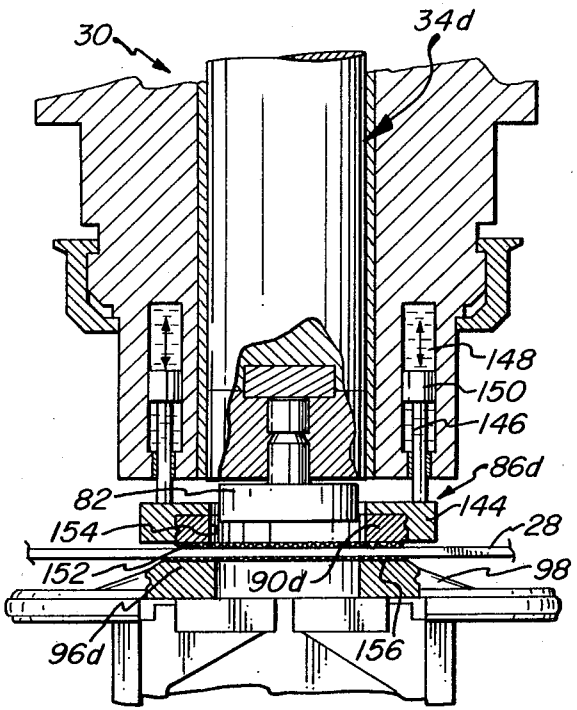
FIG. 9 is a fragmentary sectional and partially diagrammatic view of the ram assembly and die assembly of a punch press having a rotatable ram assembly carrying a hydraulically reciprocable stripper assembly with the stripper and die assembly being adapted to grip the workpiece therebetween.

Turning now to FIG. 9, the punch press has a rotatable lower portion **34*d* on the ram assembly 30 and the stripper holder assembly 86*d* is carried at the lower end of the portion 34*d*. The punch 82 is locked in the clamping mechanism (not shown) of the ram lower portion 34*d*. The stripper tool holder 144 is supported on piston rods 146, and is reciprocatable by pressurized hydraulic fluid introduced into the chamber 148 above and below the pistons 150 through conduits (not shown). The holder 144 carries stripper tooling 90*d* which has a layer 152 of resiliently compressible material on its lower face and a central aperture 154 for passage of the punch 82** therethrough.

On the upper surface of the die **96*d* is a layer 156 of resiliently compressible material. When so desired, the stripper holder 144 is moved downwardly by hydraulic fluid admitted to the chamber 148 to clamp the workpiece 28 tightly between the stripper tooling 90*d* and die tooling 96*d*. Rotation of the ram lower portion 34*d*** will then produce rotation of the workpiece.

Figure 10:
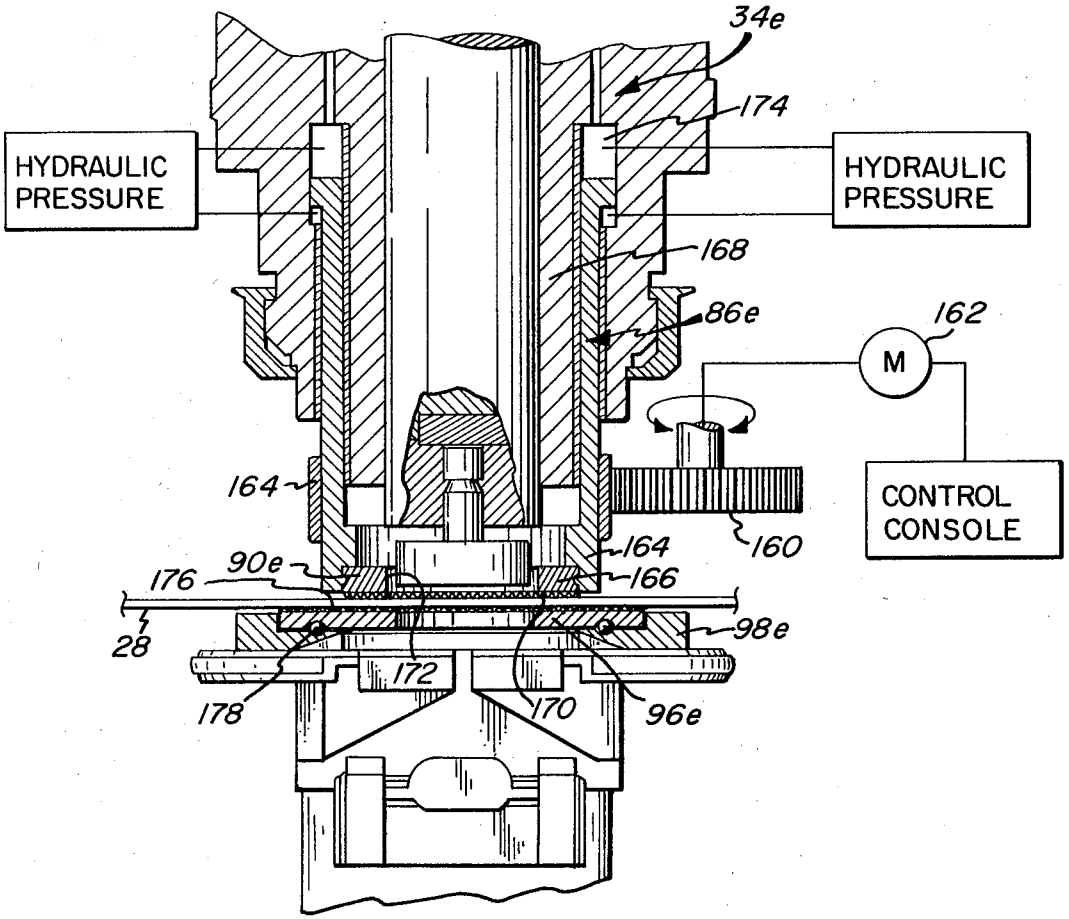
FIG. 10 is a similar fragmentary view of another embodiment of punch press wherein the hydraulically reciprocatable stripper assembly is rotatable about the ram assembly.

In FIG. 10, there is illustrated a punch press which may or may not have a rotatable ram lower portion **34*e*. In this embodiment, the stripper assembly 86*e* is rotatable about the lower portion 34*e* by a pinion gear 160 driven by a bi-directional motor 162 operated by the control console. The pinion gear 160 is engaged with the elongated axially extending teeth on the ring gear 164 secured to the stripper housing 166 which is slidable on the sleeves 168. At its lower end, the housing 166 carries stripper tooling 90*e* with a layer 170 of resiliently deformable material on its face and an aperture 172 for the punch 82 to pass therethrough. Hydraulic fluid admitted to the upper end of the chamber 174 will move the stripper housing 166 downwardly to bear against the upper surface of the workpiece 28 and press it against the die 96*e* which has a layer 176 of resiliently deformable material on its upper surface. In this embodiment, the die 90*e* is rotatably supported in the die holder block 98*e* by a ball bearing assembly 178. When the workpiece 28 is firmly clamped, the pressure on the clamped assembly will rotate both the workpiece 28 and die 90***e* as the motor 162 effects rotation of the stripper assembly 86*e*.

Figure 11:
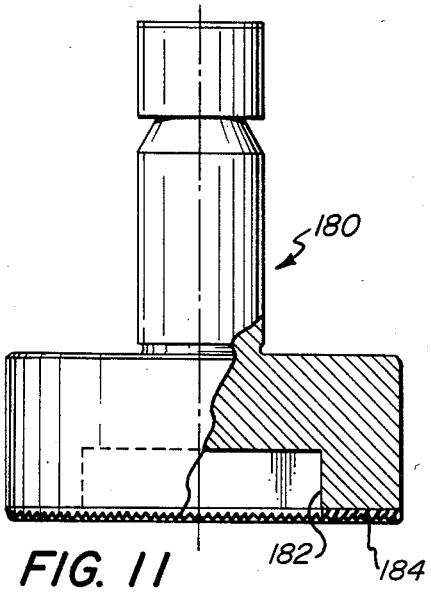
FIG. 11 is a partially sectional view of tooling adapted to be mounted on the punch tool mounting portion of a ram assembly for the practice of the present invention.
Figure 12:
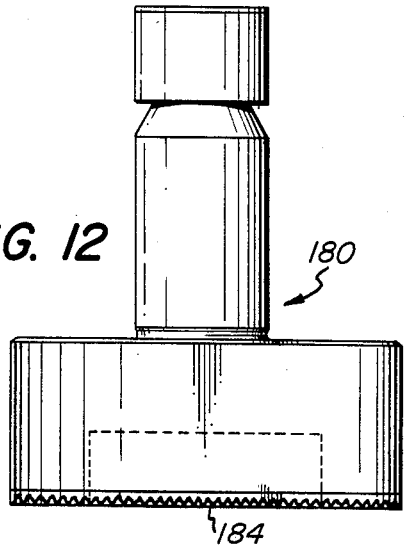
FIG. 12 is a side elevational view thereof.

In FIGS. 11 and 12, there is illustrated tooling 180 for mounting in the punch holder of the ram assembly. This tooling has a central recess 182 in its lower face and a layer 184 of resiliently compressible material thereabout.

Figure 13:
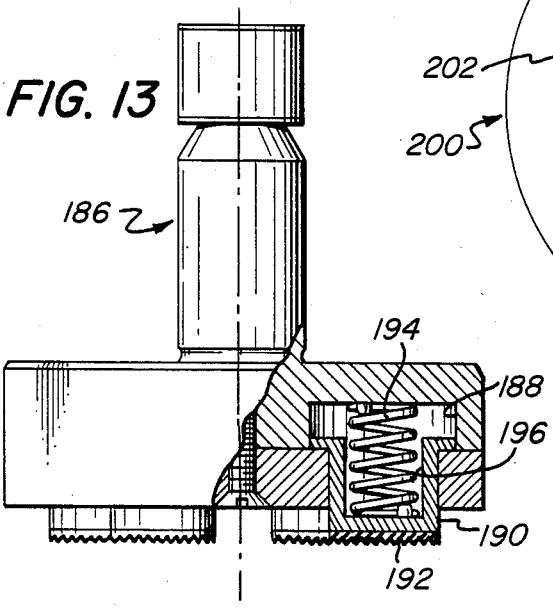
FIG. 13 is a partially sectional view of another embodiment of tooling adapted to be mounted on punch tool mounting portion of the ram assembly.

In FIG. 13, there is illustrated another embodiment of tooling 186 for mounting in the punch holder. This tooling has an annular recess 188 in its lower surface in which is seated a ring member 190 with a layer 192 of resiliently compressible material on its outer surface. Compression springs 194 seated in recesses 196 spaced about the inner surface of the ring member 190 bias the ring member 190 outwardly of the recess 188.

Figure 15:
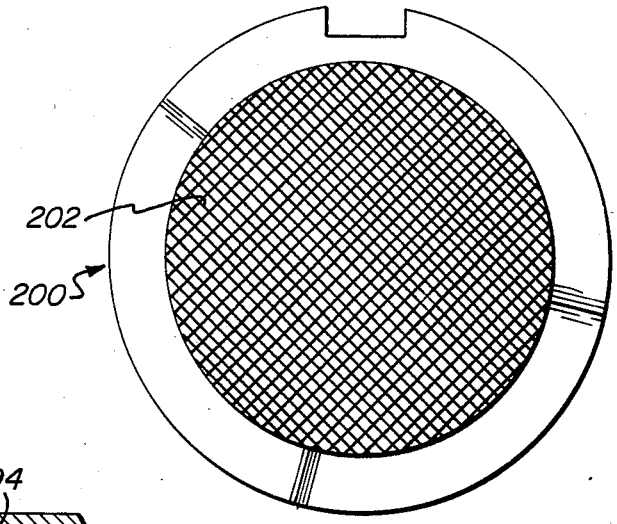
FIG. 15 is a plan view thereof.
Figure 14:
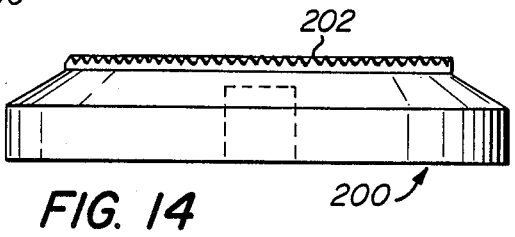
FIG. 14 is a side elevational view of tooling to be inserted the die holder for the practice of the present invention.

In FIGS. 14 and 15, there is illustrated tooling 200 to be supported in the die holder, and this tooling has a layer 202 of resiliently compressible material on its upper surface.

Figure 16:
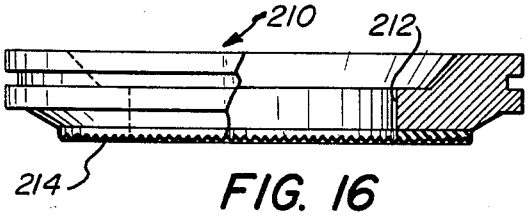
FIG. 16 is a partial side sectional view of stripper tooling to be used for the practice of the present invention.

In FIG. 16, there is illustrated stripper tooling 210 with an aperture 212 therethrough for the punch to pass therethrough and a layer 214 of resiliently compressible material thereabout.

Figures 17, 18A, 18B, 18C, 18D, 18E, 18F:
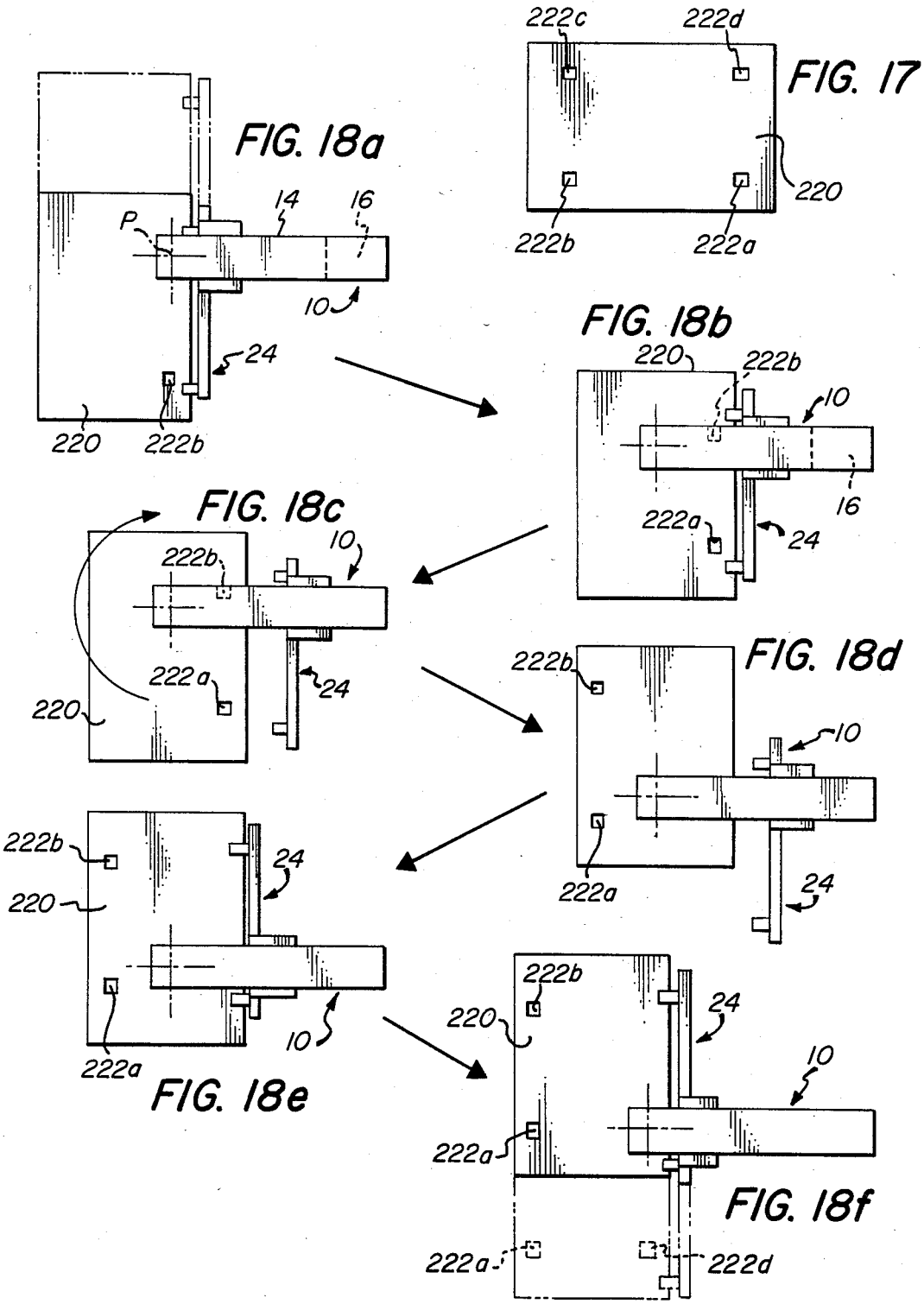
FIG. 17 is a schematic view of a part to be fabricated with cutouts spaced along opposite edge portions of the workpiece.
FIGS. 18*a*–18*f* are a series of schematic views showing the indexing and rotation of the workpiece by the method of present invention to produce the part of FIG. 17.

In FIG. 17, there is illustrated a part that can be fabricated using the present invention. In this instance, the sheet 220 uses the workpiece in its entirety and, for convenience of illustration it has a series of four holes 222*a–d* punched along two opposed side margins thereof.

The method of the present invention is illustrated in FIGS. 18*a*–18*f*. In FIG. 18*a*, the sheet 220 is shown clamped in the X-Y guidance assembly 24 which has moved it to the outer end of the throat of the press frame 10 so that the portion adjacent the guidance assembly 24 may be punched by the punch tooling which is at the position P in the head 14. This provides the cutout 222*a* in the position of the sheet 220 shown in solid line and the cutout 222*b* in the position shown in phantom line after indexing by the guidance assembly 24.

In FIG. 18*b*, the X-Y guidance assembly 24 has been moved rearwardly in the throat of the machine frame 10, i.e., towards the web section 16. In this position, the ram assembly or stripper assembly is moved downwardly to the clamp the workpiece 220. The clamps of the guidance assembly 24 are released, and the guidance assembly 24 is then moved still further inwardly of the throat to the position shown in FIG. 18*c*. The rotating mandrel assembly of the present invention is then rotated 180° in a clockwise direction, as shown by the arrow, into the position seen in FIG. 18*d*.

At the point the guidance assembly 24 is actuated and moved into position to clamp the sheet 220 as seen in FIG. 18*e*. The workpiece rotating assembly is then released by moving the ram assembly or stripper assembly upwardly. The guidance assembly 24 then moves the sheet 220 outwardly in the throat to the position seen in solid line in FIG. 18*f* to punch the hole 222*d* and then into the position shown in phantom line to punch the hole 222*c*.

As will be readily appreciated, the workpiece rotating assembly to effect rotation of the workpiece may be provided by clamping the workpiece between "punch and die" tooling with the punch tooling being moved by the ram assembly in a controlled manner against the surface of the workpiece. Generally this will require the dedication of a set of cooperating punch and die tooling for this purpose and thus reduce the amount of tooling available in an automatic tool changer assembly for punching operations. It will also generally require an increase in the amount of time to effect rotation of the workpiece because of the necessity for changing the tooling before and after doing so.

Alternatively, the rotating mandrel assembly may rely upon the combination of the stripper and its tooling, and either the surface of the die about the die opening or the surface of the die holder about the die. In this fashion, no special punch and die are required and there is no necessity for changing the tooling. Furthermore, in modern punch presses of the type employing hydraulically actuated stripper assemblies, it is easier to effect control of the downward movement of the stripper assembly than of the ram assembly stroke, and it is also easier to control the clamping forces by use of the stripper assembly than those exerted by the ram assembly.

As indicated in the illustrated embodiments, the preferred apparatus utilizes for the workpiece rotating assembly a ram assembly and a die assembly which are rotated to effect the rotary action. However, if so desired, a stripper assembly which is rotatable relative to the ram assembly may also be employed. The die or die holder may also be rotatable independently of the ram assembly, or the die or die holder may be mounted in a fashion so as to be rotatable relative to its support under the clamping pressure of the rotatable stripper assembly.

In the several illustrated embodiments, resiliently compressible material such as natural and synthetic rubber has been employed to provide the frictional clamping surface. Alternatively, the cooperating surfaces of the workpiece rotating tooling may be provided with a tacky or other nonslip coating, or those surfaces may be abraded to increase frictional surface contact. In addition to the clamping pressure provided by movement of the reciprocatable ram portion or stripper assembly, the clamping surfaces may be spring biased to increase the clamping pressure.

As will be readily appreciated, a control program for the punch press may be readily generated to provide the desired movement of the workpiece to the position for clamping by the workpiece rotating assembly for rotation thereby, to move the guidance assembly to a withdrawn position to permit the rotation of the workpiece thereby, to rotate the workpiece, and then to move the guidance assembly to clamp the reoriented workpiece for further processing. In this fashion substantially the entire surface area of most workpieces may be acted upon by the press to avoid waste and necessity for subsequent operations.

Reference may be made to Herb et al, U.S. Pat. No. 4,274,801 granted on June 23, 1981 for further description of X-Y guidance systems for the workpiece.

For detailed descriptions of suitable tool changer mechanisms, reference may be made to Herb, U.S. Pat. No. 3,816,904 granted June 18, 1974; and Herb et al, U.S. Pat. No. 4,103,414 granted August 1, 1978.

References may be made to the aforementioned copending Klingel U.S. application Ser. No. 661,399 filed 10/16/84 entitled "Punch Press with Rotary Ram and Method of Operating Same" for greater details on the preferred punch press structures utilizing drive means for rotating the tooling mounted on the ram assembly and in the die holder. The punch press of the Klingel application affords excellent control of the punching operation and the opportunity to minimize tool wear due to the fact that the punch and die are rigidly supported on the ram assembly and in the die holder assembly. The gear drive mechanism provides a relatively rugged assembly with precise control over the amount of rotation, and the rotation is simultaneously effected by the common drive mechanism. In the automatic tool changer embodiment, all tooling is readily available for use on the relatively rotatable ram and die holder members so as to afford a high degree of versatility and rapid tool change.

Thus, it can be seen from the foregoing description and attached drawings that the method and apparatus of the present invention enable workpieces to be rotated to a new orientation on the punch press for reclamping by the guidance assembly, all with automatic control and precision. The punch press assemblies used for the method of the present invention employ tooling that may be moved relative to each other to clamp the workpiece therebetween, and then to rotate the workpiece, without marring the surface of the workpiece. In this fashion, substantially the entire surface of most workpieces may be subjected to punching operations.

Having thus described the inventions, what is claimed is:

1. In a method for punching cutouts in a sheet-like workpiece, the steps comprising:

A. providing a punch press having a frame with a base and a head spaced thereabove supporting a ram assembly, workpiece clamping and moving means for moving a workpiece between said base and head along X and Y axes, tool mounting means mounted on said head for reciprocal movement along a vertical axis and rotatable about said axis, and a die assembly in said base in alignment with said ram assembly;

B. mounting in said tool mounting means workpiece gripping tooling adapted to engage a workpiece when brought into contact therewith;

C. supporting a sheet-like workpiece on said base between said die assembly and said head;

D. gripping said workpiece in said workpiece clamping and moving means;

E. moving said tool mounting means along said vertical axis to bring said workpiece gripping tooling into contact with said workpiece and to clamp said workpiece between said gripping tooling and said base;

F. releasing said workpiece from said workpiece clamping and moving means;

G. rotating said tool mounting means about said vertical axis and thereby rotating said workpiece on said base to effect reorientation thereof relative to said X and Y axes;

H. reengaging said workpiece in the reoriented position in said workpiece clamping and moving means; and I. moving said tool mounting means away from said workpiece to release it from said workpiece gripping tooling.

2. The method in accordance with claim 1 wherein said workpiece gripping tooling frictionally engages said workpiece.

3. The method in accordance with claim 1 wherein said workpiece is clamped between said workpiece gripping tooling and said die assembly, at least a portion of said die assembly rotating with said workpiece and said tool mounting means.

4. The method in accordance with claim 3 wherein said method includes the step of mounting in said die assembly second workpiece gripping tooling cooperating with that of said head to frictionally engage said workpiece therebetween.

5. The method in accordance with claim 3 wherein said die assembly includes a die holder rotatably supported in said base which rotates with said workpiece upon rotation of said tool mounting means.

6. The method in accordance with claim 5 wherein said die holder has a die-receiving recess therein and workpiece gripping means disposed thereabout to cooperate with said workpiece gripping tooling of said head to frictionally engage said workpiece therebetween.

7. The method in accordance with claim 1 wherein said tool mounting means is on a portion of said ram assembly, wherein said portion of said ram assembly is rotatable about said axis, and wherein the step of rotation is effected by rotation of said portion of said ram assembly.

8. The method in accordance with claim 7 wherein said tool mounting means comprises punch mounting means on said rotatable portion of said ram assembly and said step of mounting said work gripping tooling comprises inserting said tooling into said punch mounting means, and said step of moving said tool mounting means comprising moving said ram assembly portion downwardly in a controlled manner to effect the clamping engagement.

9. The method in accordance with claim 7 wherein said tool mounting means comprises a stripper assembly vertically movable on said ram assembly independently of vertical movement of said ram portion, wherein said step of mounting said workpiece gripping tooling comprises inserting said tooling into said stripper assembly, wherein said step of moving said tool mounting means comprises moving the portion of said stripper assembly carrying said tooling in a controlled manner to effect the clamping engagement.

10. The method in accordance with claim 1 wherein said tool mounting means comprises a stripper assembly vertically movable on said ram assembly independently of vertical movement of said ram assembly, wherein said step of mounting said workpiece gripping tooling comprises inserting said tooling into said stripper assembly, wherein said step of moving said tool mounting means comprises moving the portion of said stripper assembly carrying said tooling in a controlled manner to effect the clamping engagement, and wherein said step of rotation comprises the rotation of said portion of said stripper assembly.

11. In a punch press, the combination comprising:

A. a frame providing a base and a head spaced thereabove;

B. tool mounting means mounted on said head for movement along a vertical axis towards and away from said base and for rotation about said axis;

C. first drive means for rotating said tool mounting means;

D. second drive means for effecting controlled reciprocal movement of said tool mounting means along said vertical axis;

E. workpiece clamping and moving means for moving a workpiece between said base and said head along X and Y axes;

F. workpiece gripping tooling in said tool mounting means adapted to engage a workpiece on said base when brought into contact therewith; and G. control means for controlling the operation of said first and second drive means and said workpiece clamping and moving means, said control means being operable (i) to operate said second drive means to move said tool mounting means along said vertical axis a controlled distance to clamp an associated workpiece against said base, (ii) to release the associated workpiece from said workpiece clamping and moving means, (iii) to operate said first drive means and rotate said tool mounting means and thereby the associated workpiece a predetermined amount, (iv) to reengage the associated workpiece in said workpiece clamping and moving means, and (v) to operate said second drive means to move said tool mounting means away from said base and release the clamping force on the associated workpiece.

12. The punch press in accordance with claim 11 wherein said punch press includes a ram assembly in said head with a lower portion reciprocatable along said axis and rotatable about said axis, wherein said tool mounting means is supported on said ram assembly lower portion and rotatable therewith, and wherein said first drive means effects rotation of said ram assembly lower portion and thereby said tool mounting means.

13. The punch press in accordance with claim 12 wherein said tool mounting means comprises punch mounting means on said ram lower portion and wherein said workpiece gripping tooling is mounted therein and includes friction means on its lower surface.

14. The punch press in accordance with claim 12 wherein said punch press includes a stripper assembly on said head rotatable with said ram assembly lower portion and having a portion movable along said vertical axis which includes said tool mounting means.

15. The punch press in accordance with claim 14 wherein said workpiece gripping tooling comprises stripper tooling including friction means on its lower surface.

16. The punch press in accordance with claim 11 wherein said punch press includes a stripper assembly on said head having a portion movable along said vertical axis and which includes said tool mounting means, at least said portion being rotatable about said axis and being engaged with said first drive means to effect rotation thereby.

17. The punch press in accordance with claim 16 wherein said workpiece gripping tooling comprises stripper tooling including friction means on its lower surface.

18. The punch press in accordance with claim 11 wherein there is included a die assembly in said base including at least a portion rotatable about said vertical axis.

19. The punch press in accordance with claim 18 wherein there is included second workpiece gripping tooling in said die assembly cooperating with that of said head to engage the associated workpiece therebetween.

20. The punch press in accordance with claim 19 wherein said die assembly includes a die holder rotatably supported in said base which rotates with the associated workpiece.

21. The punch press in accordance with claim 20 wherein said die holder has a die-receiving recess therein and workpiece gripping means disposed thereabout to cooperate with said gripping tooling of said head to frictionally engage the associated workpiece therebetween.

* * * * *